US012758889B2

(12) United States Patent
Khalsa et al.

(10) Patent No.: US 12,758,889 B2
(45) Date of Patent: Oct. 13, 2026

(54) DOLL HEAD WITH BOX BRAID HAIR AND METHOD FOR FORMING THEREOF

(71) Applicant: Jakks Pacific Inc., Santa Monica, CA (US)

(72) Inventors: Jaskaram Khalsa, Palm Desert, CA (US); Danielle Dineen, Venice, CA (US)

(73) Assignee: JAKKS PACIFIC INC., Santa Monica, CA (US)

( * ) Notice: Subject to any disclaimer, the term of this patent is extended or adjusted under 35 U.S.C. 154(b) by 205 days.

(21) Appl. No.: 18/665,185

(22) Filed: May 15, 2024

(65) Prior Publication Data

US 2024/0390810 A1 Nov. 28, 2024

Related U.S. Application Data

(60) Provisional application No. 63/469,012, filed on May 25, 2023.

(51) Int. Cl.
*A63H 3/44* (2006.01)
*A63H 9/00* (2006.01)

(52) U.S. Cl.
CPC ..... *A63H 3/44* (2013.01); *A63H 9/00* (2013.01)

(58) Field of Classification Search
CPC ..... A63H 3/44; A45D 44/14
See application file for complete search history.

(56) References Cited

U.S. PATENT DOCUMENTS 1,627,511 A * 5/1927 Hopf ..... A63H 3/44 446/394
2,152,085 A * 3/1939 Palmer ..... A63H 3/44 446/394
2,175,693 A * 10/1939 Meyer ..... A63H 3/44 132/201
2,670,570 A * 3/1954 Gnaizda ..... A63H 3/44 132/201
2,975,534 A * 3/1961 Lutz ..... G09B 25/00 36/72 B
3,458,943 A * 8/1969 Trowbridge ..... A45D 44/14 434/94
3,500,578 A 3/1970 Irving
(Continued)

OTHER PUBLICATIONS

Notification of Transmittal of The International Search Report and the Written Opinion of the International Searching Authority for PCT/US2024/029489; date of mailing Sep. 10, 2024.
(Continued)

*Primary Examiner* — Nicholas J. Weiss
(74) *Attorney, Agent, or Firm* — TOPE-MCKAY & ASSOCIATES

(57) ABSTRACT

Described is a doll head with box braid hair and associated method for forming such a doll head. The doll head has an exterior scalp surface with a box rooting pattern formed thereon. The box rooting pattern includes a plurality of distinct box shapes separated by un-patterned scalp. A plurality of hair filaments are rooted within each of the distinct box shapes and extend therefrom. Notably, the hair filaments within each of the distinct box shapes are braided together to form a hair box braid extending from and bound on the exterior scalp surface by the distinct box shape.

4 Claims, 8 Drawing Sheets

(56) References Cited

U.S. PATENT DOCUMENTS

| | | | | | |
|---|---|---|---|---|---|
| 3,765,123 | A * | 10/1973 | Terzian | A63H 3/44 | 446/394 |
| 4,070,790 | A * | 1/1978 | Strongin | A63H 3/44 | 446/394 |
| 4,403,962 | A * | 9/1983 | La Vista | G09B 25/00 | 434/94 |
| 5,607,338 | A | 3/1997 | Landi | | |
| 6,527,618 | B1 | 3/2003 | Faunda | | |
| 11,533,981 | B1 * | 12/2022 | Amis | A45D 44/14 | |
| D980,925 | S * | 3/2023 | Ferguson | D21/659 | |
| 2006/0141900 | A1 * | 6/2006 | Wesley | A63H 3/44 | 446/394 |
| 2007/0269772 | A1 * | 11/2007 | Taya | G09B 19/24 | 434/94 |
| 2011/0300773 | A1 * | 12/2011 | Fong | A63H 3/44 | 446/394 |

OTHER PUBLICATIONS

The International Search Report for PCT/US2024/029489; date of mailing Sep. 10, 2024.
The Written Opinion of the International Searching Authority for PCT/US2024/029489; date of mailing Sep. 10, 2024.

* cited by examiner

200

200

200

200

DOLL HEAD WITH BOX BRAID HAIR AND METHOD FOR FORMING THEREOF

CROSS-REFERENCE TO RELATED APPLICATIONS

This is a non-provisional application of U.S. Ser. No. 63/469,012, filed on May 25, 2023, the entirety of which is incorporated herein by reference.

BACKGROUND OF THE INVENTION

(1) Field of Invention

The present invention relates to toy dolls and, more specifically, to a doll head with box braid hair and associated method for forming such a doll head.

(2) Description of Related Art

Toy dolls have been devised with a variety of hair techniques and patterns. By way of example, some toy dolls have doll heads with molded and then painted hair. Such a process is relatively inexpensive, yet fails to provide a realistic look. As an improvement over molded and painted hair, some dolls have been devised to include hair that is woven through the doll head to provide hair filaments that can be styled or otherwise flow from the doll head. Generally speaking, such woven hair provides for a relatively realistic appearance. Existing techniques for weaving hair into the doll head include a spiral and cross-stitch process in which the hair is woven with a machine around the exterior of the doll head in an expanding spiral pattern. A cross-stitch is used within the interior of the doll head to permanently affix the filaments to the doll head. While such a process is effective for a variety of hair textures and styles, existing spiral weaving techniques do not work on box braid hair styles. Box braids are a type of hair-braiding in which hair is braided together from the scalp in a "boxy" pattern, forming several square-shaped (or other shaped) hair divisions. Nothing heretofore devised has provided for a doll head with realistic box braids.

Thus, a continuing need exists for a new and improved doll head with box braid hair and associated method for forming such a doll head.

SUMMARY OF INVENTION

The present disclosure provides a doll head with box braid hair and associated method for forming such a doll head. The doll head has an exterior scalp surface with a box rooting pattern formed thereon. The box rooting pattern includes a plurality of distinct box shapes separated by un-patterned scalp. Notably, a plurality of hair filaments are rooted within each of the distinct box shapes and extend therefrom.

In another aspect, the un-patterned scalp remains free of rooted hair filaments.

In yet another aspect, the hair filaments within each of the distinct box shapes are braided together to form a hair box braid extending from and bound on the exterior scalp surface by the distinct box shape.

In another aspect, the distinct box shapes are formed as markings on the exterior scalp surface.

Finally, as can be appreciated by one skilled in the art, the present invention also comprises a method for forming and using the invention as described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to toy dolls and, more specifically, to a doll head with box braid hair and associated method for forming such a doll head. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
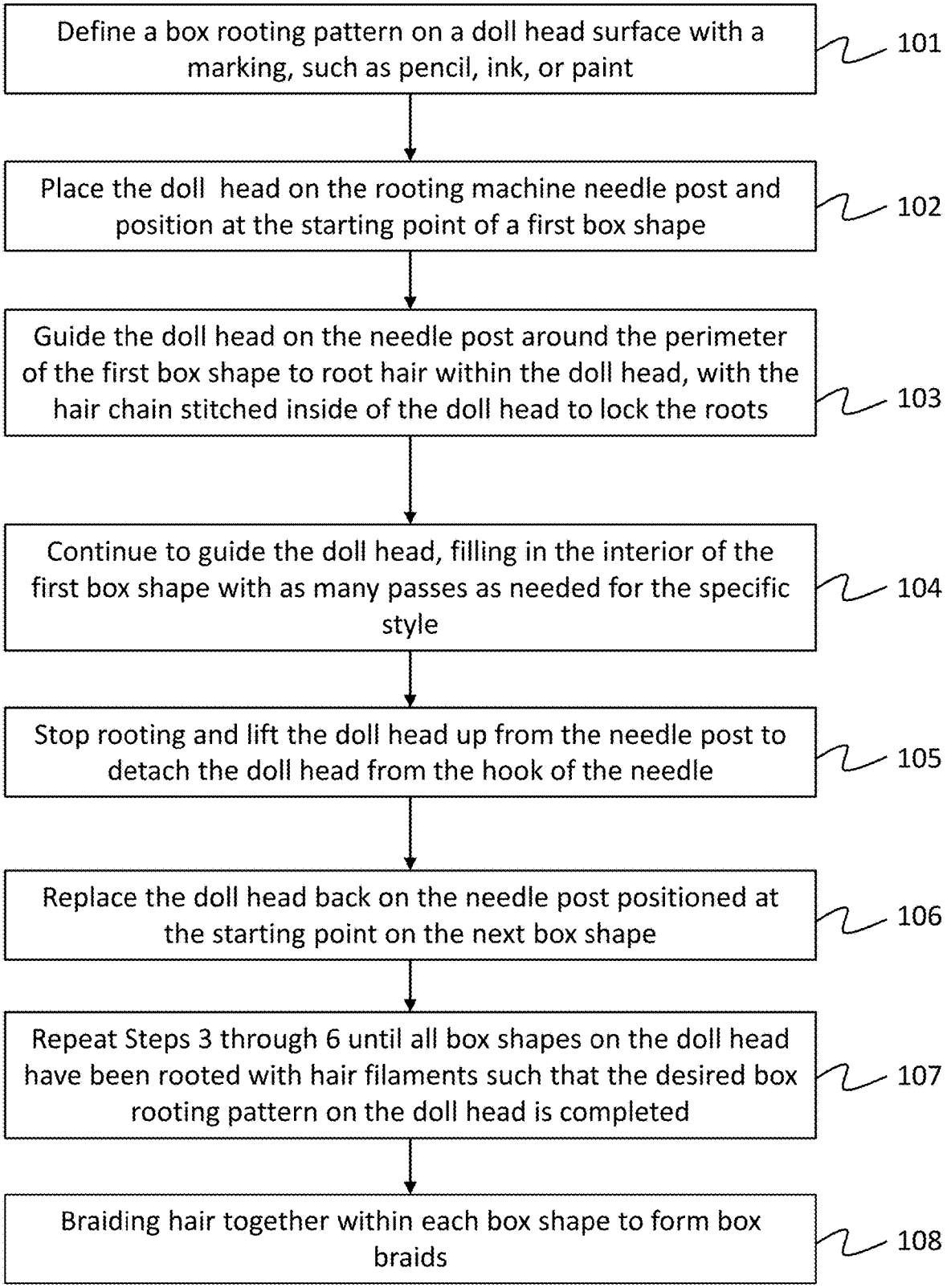
FIG. 1 is a flowchart depicting a method for forming a doll head with box braids according to various embodiments of the present invention.
Figure 2A:
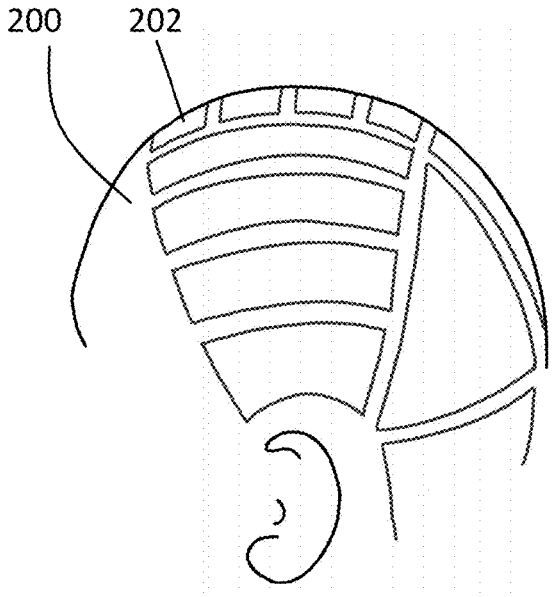
FIG. 2A is a left-view illustration of a doll head with a plurality of box shapes to collectively form a box rooting pattern according to various embodiments of the present invention.
Figure 2B:
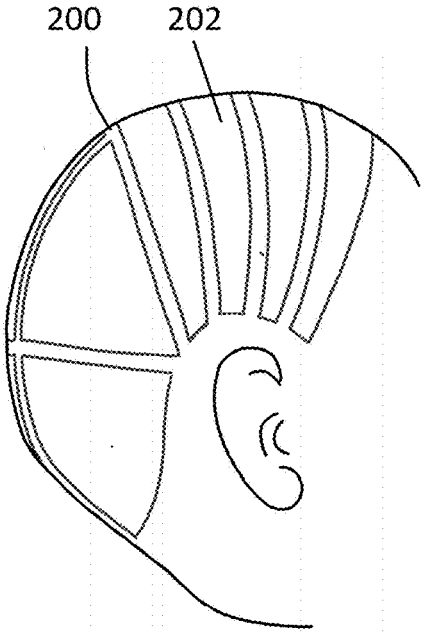
FIG. 2B is a right-view illustration of the doll head as illustrated in FIG. 2A.
Figure 2C:
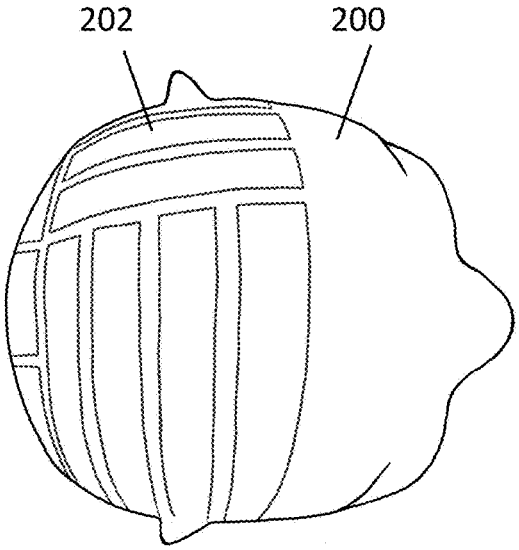
FIG. 2C is a top-view illustration of the doll head as illustrated in FIG. 2A.
Figure 2D:
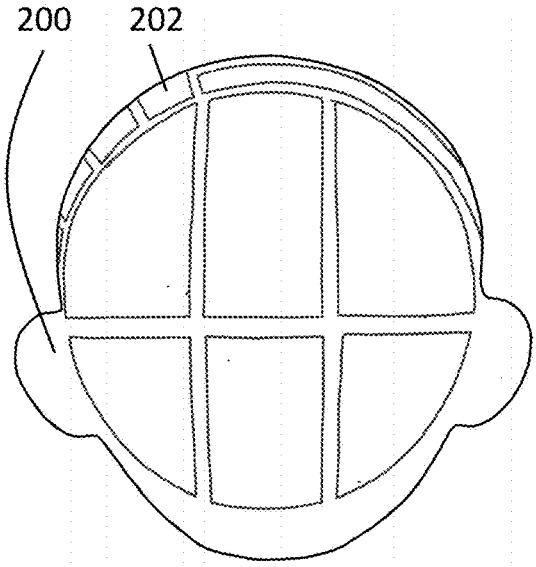
FIG. 2D is a rear-view illustration of the doll head as illustrated in FIG. 2A.

The present invention relates to toy dolls and, more specifically, to a doll head with box braid hair and associated method for forming such a doll head. The doll head with box braids is unique in that it provides a more realistic appearance of box braids on a doll than the prior art. The unique method by which the doll head is formed results in the improved doll head with box braids. As a non-limiting example and as depicted in FIG. 1, the method can be performed by first defining the box rooting pattern 101 on the exterior surface of the doll head where it is desirable to have hair. The box rooting pattern is defined on the doll head surface with pencil, ink, colored plastic molding, or paint (or any other marking means). The box rooting pattern is ideally colored to approximately match the color of the hair filaments that are being rooted into the doll head. Notably, the box rooting pattern includes a plurality of distinct box shapes separated by un-patterned scalp. Thereafter, the doll head is placed 102 on the rooting machine needle post and positioned at the starting point of a first box shape.

Doll hair rooting machines are known to those skilled in the art and are any suitable doll hair rooting machine capable of positioning and affixing doll hair with a doll head while rooting the doll hair within an interior of the doll head. Such rooting machines have a needle post that punctures the doll head while affixing multiple strands of hair such that the hair flows on the exterior of the doll head while being rooted together on the interior of the doll head. As a non-limiting example, such a machine is capable of chain stitching the doll hair together on the interior of the doll head.

With the needle post positioned in the first box shape, the doll head is then guided 103 on the needle post around the perimeter (or at least within the first box shape) of the first box shape to root hair within the doll head within the distinct box shapes. In doing so, the hair is chain stitched on the inside of the doll head to lock the roots. The head is then further guided 104 on the needle posted to fill in the interior of the first box shape with as many passes as needed for the specific style.

Once the first box shape is filled, the process continues in which the user or machine stops rooting within the first box shape and removes (e.g., lifts) the doll head up from the needle post to detach the doll hod from the hook of the needle. The doll head is then repositioned 106 on the needle post at a starting point on the next box shape. The doll head is then guided to fill in the next box shape with hair filaments, with the hair filaments being rooted to the doll head. This process of removing the doll head from the needle and repositioning the needle to the next box shape is repeated 107 until the entire box rooting pattern on the doll head is completed. Desirably (although not required), when the rooting is completed, the un-patterned scalp remains free of rooted hair filaments.

Finally, when all of the hair filaments have been rooted within the box shapes, the hair filaments within each box shape are braided together 108 to form box braids. The resulting doll head has a plurality of box shapes, each with hair filaments braided together to form box braids.

For further understanding, FIGS. 2A through 2D depict left, right, top, and rear-view illustrations of a doll head 200 with a plurality of box shapes 202. As can be appreciated by those skilled in the art, the method as described herein can be performed with any box rooting pattern. Thus, submitted herewith are several non-limiting examples of box rooting patterns with a plurality of box shapes in which the hair filaments can be rooted and thereafter braided. More specifically, FIGS. 6A through 9D provide top, left, rear, and right, view illustrations of various doll heads 200 with different box rooting patterns.

Figure 3A:
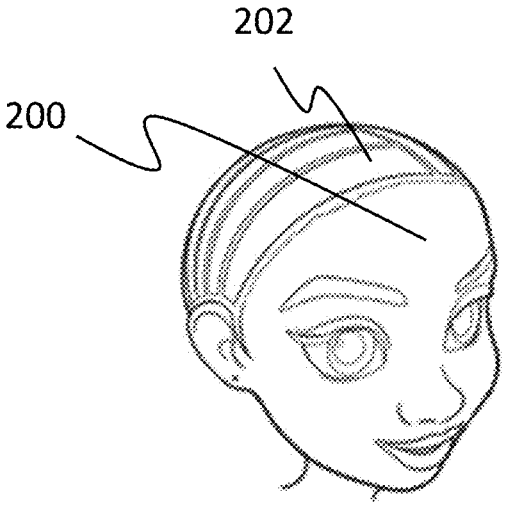
FIG. 3A is a front, right-view illustration of the doll head.
Figure 3B:
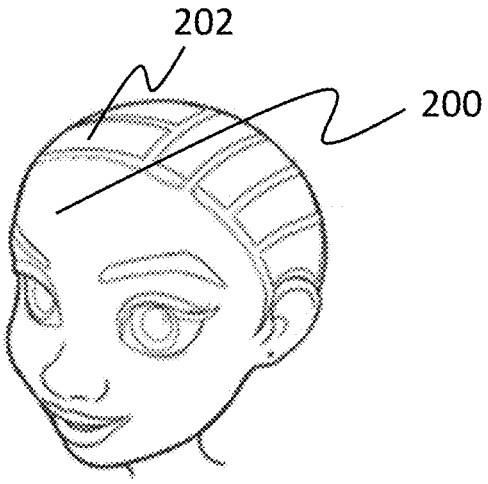
FIG. 3B is a front, left-view illustration of the doll head.
Figure 4A:
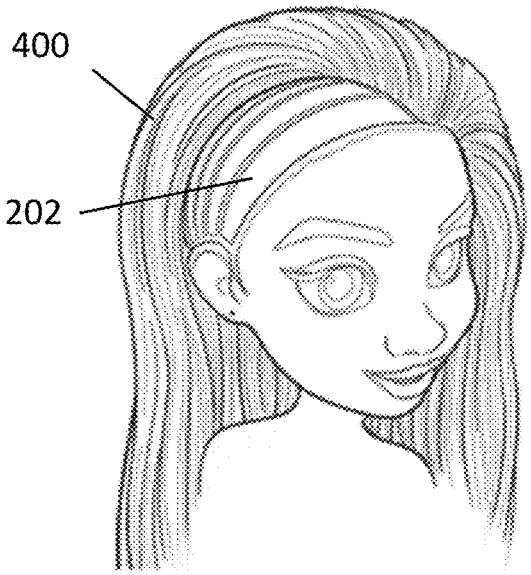
FIG. 4A is a front, right-view illustration of the doll head, depicting hair strands as rooted on the doll head in a portion of the box rooting pattern.
Figure 4B:
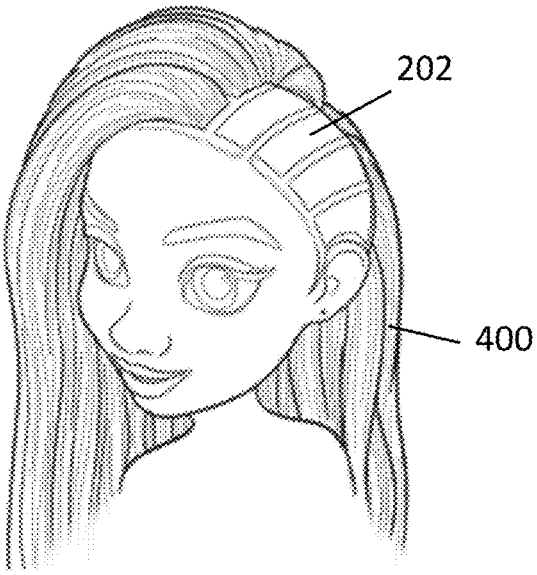
FIG. 4B is a front, left-view illustration of the doll head, depicting hair strands as rooted on the doll head in a portion of the box rooting pattern.
Figure 5A:
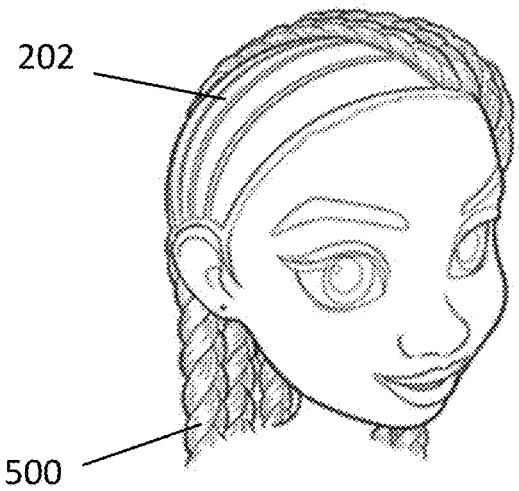
FIG. 5A is a front, right-view illustration of the doll head, depicting hair strands within each box shape being braided together to form box braids.
Figure 5B:
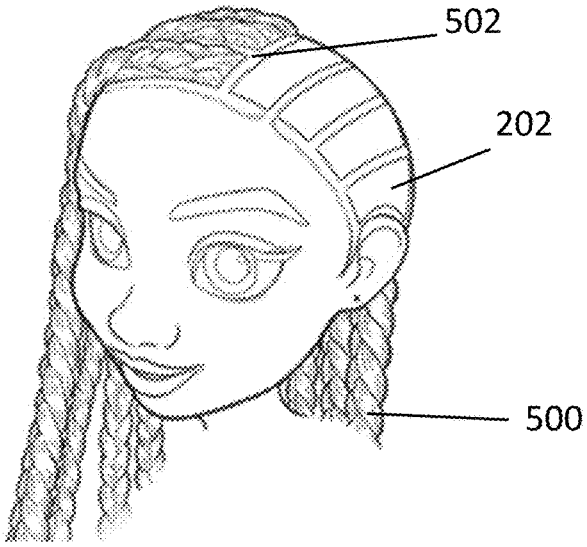
FIG. 5B is a front, left-view illustration of the doll head, depicting hair strands within each box shape being braided together to form box braids.
Figure 6A:
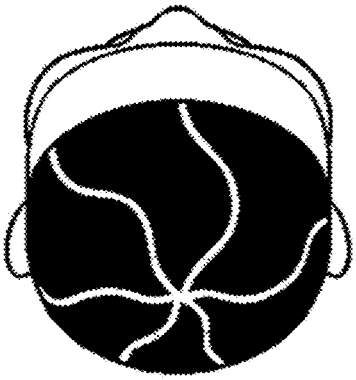
FIG. 6A is a top-view illustration of a doll head with a second box rooting pattern.
Figure 6B:
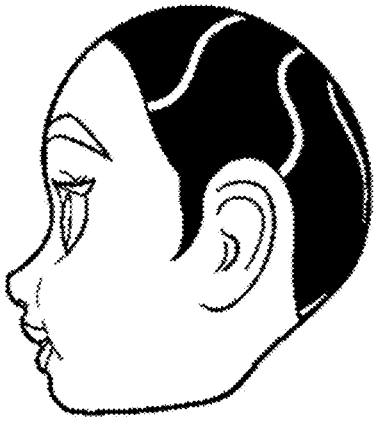
FIG. 6B is a left-view illustration of the doll head depicted in FIG. 6A.
Figure 6C:
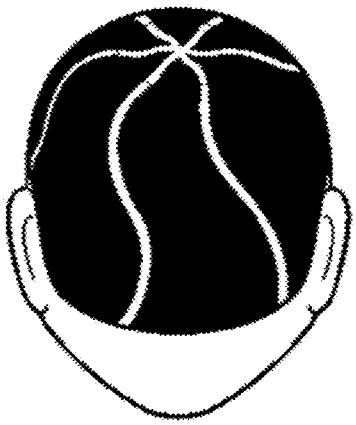
FIG. 6C is a rear-view illustration of the doll head depicted in FIG. 6A.
Figure 6D:
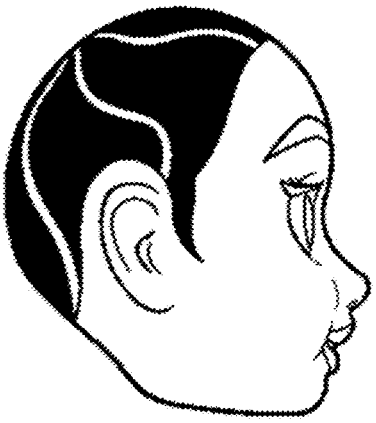
FIG. 6D is a right-view illustration of the doll head depicted in FIG. 6A.
Figure 7A:
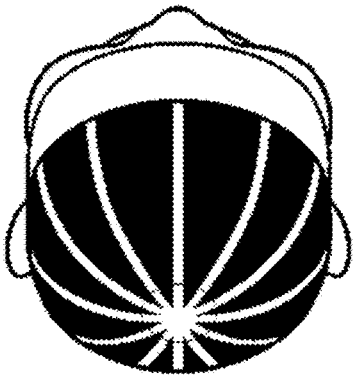
FIG. 7A is a top-view illustration of a doll head with a third box rooting pattern.
Figure 7B:
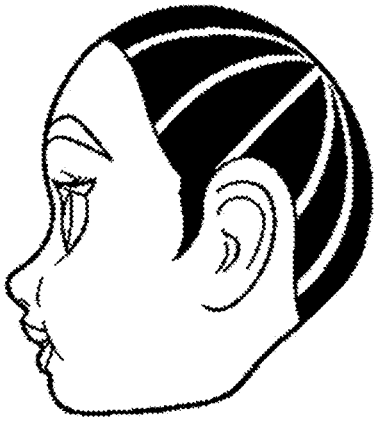
FIG. 7B is a left-view illustration of the doll head depicted in FIG. 7A.
Figure 7C:
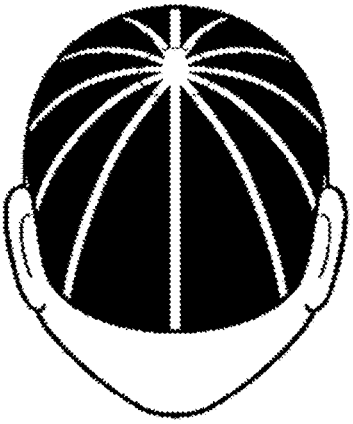
FIG. 7C is a rear-view illustration of the doll head depicted in FIG. 7A.
Figure 7D:
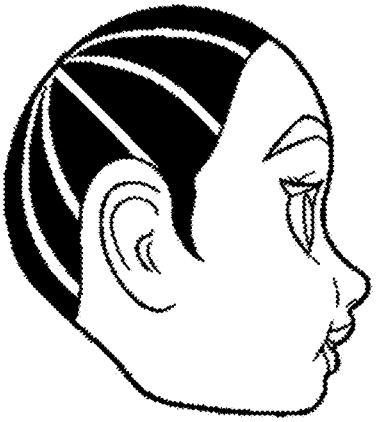
FIG. 7D is a right-view illustration of the doll head depicted in FIG. 7A.
Figure 8A:
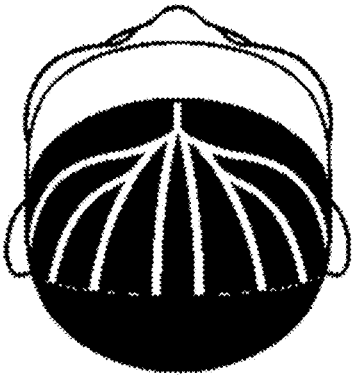
FIG. 8A is a top-view illustration of a doll head with a fourth box rooting pattern.
Figure 8B:
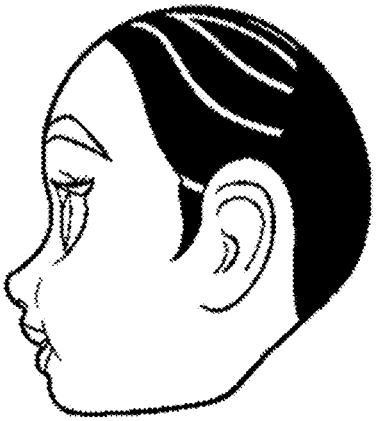
FIG. 8B is a left-view illustration of the doll head depicted in FIG. 8A.
Figure 8C:
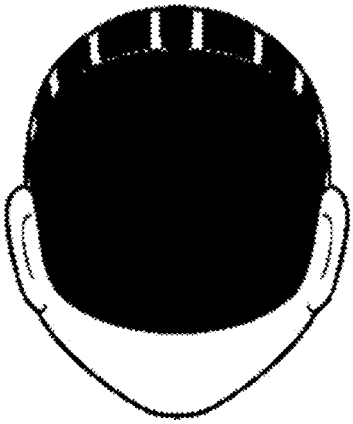
FIG. 8C is a rear-view illustration of the doll head depicted in FIG. 8A.
Figure 8D:
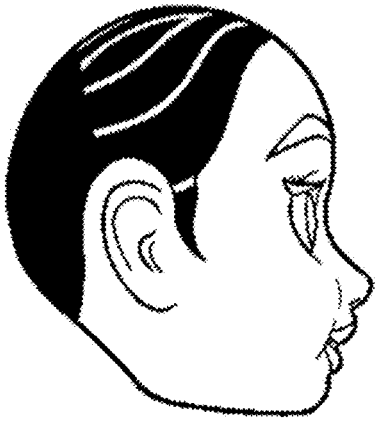
FIG. 8D is a right-view illustration of the doll head depicted in FIG. 8A.
Figure 9A:
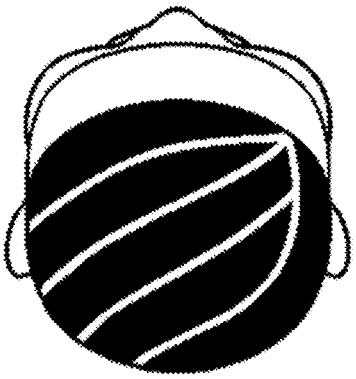
FIG. 9A is a top-view illustration of a doll head with a fifth box rooting pattern.
Figure 9B:
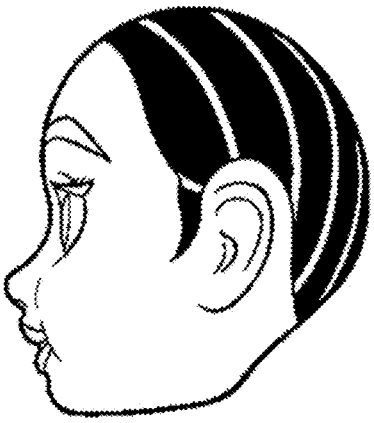
FIG. 9B is a left-view illustration of the doll head depicted in FIG. 9A.
Figure 9C:
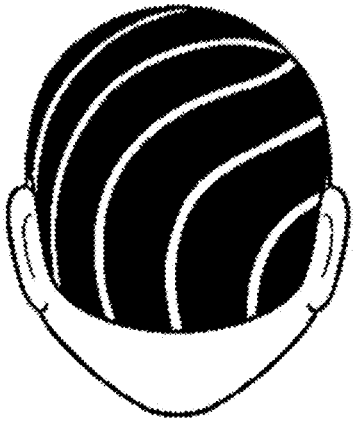
FIG. 9C is a rear-view illustration of the doll head depicted in FIG. 9A.
Figure 9D:
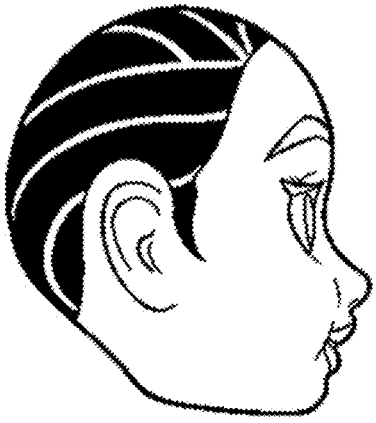
FIG. 9D is a right-view illustration of the doll head depicted in FIG. 9A.

The overall process is further depicted in FIGS. 3A through 5C. As shown in FIGS. 3A and 3B, a doll head 200 is formed to have a box rooting pattern with a plurality of box shapes 202. Thereafter and as shown in FIGS. 4A and 4B, hair filaments 400 are rooted into the box shapes 202. As shown in FIGS. 5A and 5B, with the hair filaments rooted into the doll head, the hair filaments within each box shape 202 can then be braided together to form the box braids 500. It is noted that in some aspects it is desirable to root all the hair filaments in all of the box shapes before braiding the filaments together to form the box braids; however, FIGS. 5A and 5B depict only a portion of the head as having been rooted with filaments for illustrative purposes. Thus, in other aspects and as shown in FIGS. 5A and 5B, the filaments can be braided into box braids 500 while some of the box shapes remain unrooted or filament free. In either case, the doll head has box braids that are braided within the box shape (i.e., being bound on the exterior scalp surface by the box shape), with the box shape and attached box braids 500 being separated by un-patterned scalp 502. The un-patterned scalp

502 is typically the same color as the facial skin on the doll head which provides a very realistic appearance in simulating real box braids.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A method for forming a doll head with box braid hair, comprising acts of:

defining a box rooting pattern on the doll head surface with a marking, the box rooting pattern including a plurality of distinct box shapes separated by un-patterned scalp; and affixing a plurality of box braids to the doll head such that the box braids extend from and are bound on the doll head surface by the distinct box shapes;

wherein affixing the plurality of box braids to the doll head further comprises acts of:

placing the doll head on a rooting machine needle post and positioning the doll head at the starting point of a first box shape in the plurality of distinct box shapes;

guiding the doll head on the needle post within the first box shape to apply hair filaments to the doll head by rooting the hair filaments within the first box shape;

removing the doll head up from the needle post when the first box shape is filled with desired hair filaments;

continuing to place the doll head on the rooting machine needle post at a starting point on next box shapes and rooting hair filaments in the next box shapes until the box rooting pattern is filled with hair filaments; and braiding hair filaments within each box shape to form the box braids.

2. The method as set forth in claim 1, wherein when the box rooting pattern is filled with hair filaments, the un-patterned scalp remains free of rooted hair filaments.

3. A doll head with box braid hair formed according to the process as set forth in claim 1.

4. A doll head with box braid hair formed according to the process as set forth in claim 2.

* * * * *